US005638754A

United States Patent [19]

Steinmeier et al.

[11] Patent Number: 5,638,754

[45] Date of Patent: Jun. 17, 1997

[54] APPARATUS FOR CHANGING PRINTING CYLINDER SLEEVES IN PRINTING MACHINES

[75] Inventors: Bodo Steinmeier; Klaus Schirrich, both of Bielefeld; Wilfried Kolbe, Gülzow, all of Germany

[73] Assignee: Fischer & Krecke GmbH & Co., Bielefeld, Germany

[21] Appl. No.: 685,407

[22] Filed: Jul. 24, 1996

[30] Foreign Application Priority Data

Oct. 18, 1995 [EP] European Pat. Off. ..... 95116394

[51] Int. Cl.[6] ..... B41F 21/00

[52] U.S. Cl. ..... 101/477; 101/216

[58] Field of Search ..... 101/477, 216, 101/218, 219, 378

[56] References Cited

U.S. PATENT DOCUMENTS

| | | | |
|---|---|---|---|
| 2,103,812 | 12/1937 | Ericksson | 101/378 |
| 2,245,617 | 6/1941 | Stafford et al. | 101/216 |
| 2,605,701 | 8/1952 | Huebner | 101/216 |
| 3,039,387 | 6/1962 | Zimmer et al. | 101/216 |
| 5,272,977 | 12/1993 | Horiguchl et a. | 101/378 |
| 5,394,797 | 3/1995 | Döbler et al. | 101/216 |
| 5,398,604 | 3/1995 | Burke et al. | 101/216 |
| 5,440,985 | 8/1995 | Shimmura et al. | 101/477 |
| 5,560,292 | 10/1996 | Knauer | 101/216 |

FOREIGN PATENT DOCUMENTS

| | | |
|---|---|---|
| 865614 | 10/1977 | Belgium . |
| 0290853 | 11/1988 | European Pat. Off. . |
| 0485913 | 5/1992 | European Pat. Off. . |
| 0656259 | 6/1995 | European Pat. Off. . |
| 1327229 | 4/1963 | France . |
| 4036390 | 5/1992 | Germany . |

*Primary Examiner*—Eugene H. Eickholt
*Attorney, Agent, or Firm*—Richard M. Goldberg

[57] ABSTRACT

Apparatus for changing printing cylinder sleeves in printing machines, includes two bearing blocks which serve for the rotatable support of the printing cylinder sleeve during the operation of the printing machine, a shaft running axially through the printing cylinder sleeve, and a lifter disposed at one end of the shaft outside of the corresponding bearing block, by which the shaft can be clutched and can be raised together with the printing cylinder sleeve freely cantilevered, so that the printing cylinder sleeve comes free of the bearing blocks and can be withdrawn axially from the shaft, and the printing cylinder sleeve is provided with hollow journals at both its ends, which are mounted in the bearing blocks during operation of the printing machine.

9 Claims, 2 Drawing Sheets

26
24
22
18
16
20
10
12
30
16
18
22
38
46
42
44

18
16
10
12
76
18
38
44
20
46

10
12
76
44
46
48
38
30
20

APPARATUS FOR CHANGING PRINTING CYLINDER SLEEVES IN PRINTING MACHINES

BACKGROUND OF THE INVENTION

The invention relates to an apparatus for changing printing cylinder sleeves in printing machines, including two bearing blocks which serve for the rotatable support of the printing cylinder sleeve during operation of the printing machine, a shaft running axially through the printing cylinder sleeve, and a lifter disposed at one end of the shaft, outside of the corresponding bearing block, by which the shaft together with the printing cylinder sleeve can be lifted and cantilevered, such that the printing cylinder sleeve comes free of the bearing blocks and can be withdrawn axially from the shaft.

Apparatus of this kind, which are used in printing machines with a so-called sleeve system, are known from practice. In this system the printing cylinder has a replaceable hollow cylindrical sleeve of plastic on whose external circumference the printing plates are placed. The inside diameter of the sleeve is matched to the outside diameter of the shaft so that the sleeve can be pushed onto the shaft. The outside diameter of the sleeve is determined by the desired length of the print. The printing machine can be set up for different print lengths by exchanging the sleeve.

The shaft is provided with both ends protruding from the sleeve, and has bearing sections which are mounted in the bearing blocks. The sleeve thus rests on the bearing blocks only indirectly through the shaft.

This design has the disadvantage that not only a precise mounting of the shaft in the bearing blocks, but also a precise seating of the sleeve on the shaft have to be assured if perfect print quality is to be achieved. Furthermore, the outside diameter of the bearing on the shaft must always be smaller than the inside diameter of the sleeve so that the sleeve can be pulled axially from the shaft. Therefore only a limited diameter range is available for mounting the shaft.

Another disadvantage is that the sleeves must have a relatively great wall thickness, so that the sleeves have a relatively great weight and the dimensional accuracy of production of the sleeves is made difficult.

OBJECTS AND SUMMARY OF THE INVENTION

The invention is addressed to the problem of creating an apparatus of the kind referred to above which will make possible a stable mounting of printing cylinder sleeves with widely varying outside diameters, plus an easy exchange of these sleeves.

This problem is solved by the invention in that the printing cylinder sleeve is provided with rigid hollow journals at both ends, which are mounted in the bearing blocks during operation of the printing machine.

Thus, according to the invention, the bearings are directly on the journals of the sleeve. This has the advantage that the shaft does not function as an intermediate part in the support of the sleeve during operation of the printing machine, and consequently any free play between the shaft and the sleeve can no longer impair the quality of the bearing.

The diameter of the bearings can be selected independently of the outside diameter of the sleeve to satisfy stability requirements. The bearings can consequently be so dimensioned that even sleeves designed for great print lengths, which have a relatively great outside diameter and are accordingly heavy, can be stably journaled, while in the case of shorter print length, on the other hand, the outside diameter of the sleeve can be reduced as desired, and can be even smaller than the journal diameter, if desired.

The size of the shaft needs to be established only so that when the sleeve is raised from the bearing blocks, it can withstand the flexural stresses. These flexural stresses are also diminished by the fact that the sleeve itself has a high inherent stiffness on account of the rigid character of the journals, and is prolonged beyond the length of the two journals, so that it can reach right up close to the end of the shaft that is clutched by the lifter.

While in the state of the art the sleeve is held on the shaft without free play and consequently the grip on the shaft in the lifter must be released during the operation of the printing machine, so that the shaft can rotate with the sleeve, in the case of the invention a design is possible in which the shaft is held against rotation during operation of the machine, so that the sleeve journaled in the bearing blocks can rotate on the fixed shaft without friction.

Advantageous further developments and embodiments of the invention are given in the subordinate claims.

In a special embodiment, the shaft is held against rotation, but can move axially in the lifter, and the outside diameter of the shaft decreases step-wise toward the free end. The inside diameter of the sleeve likewise decreases in steps toward the end, which corresponds to the free end of the shaft. During the operation of the printing machine the shaft is retracted axially, so that sufficient free play exists between the shaft and the sleeve on the entire length, permitting free rotation of the sleeve. When the sleeve is to be replaced, the shaft is extended axially, so that the shaft sections with the larger diameter enter with a precise fit into the corresponding sections of the bore of the sleeve. In this state the sleeve is thus held largely without free play, so that it can be raised securely by the lifter. This design has the advantage that the shaft can have along the greatest part of its length a relatively large outside diameter in proportion to the inside diameter of the sleeve, and thus can have a correspondingly great flexural resistance. The outside diameter is greatest precisely at the end of the shaft that is held in the lifter and has to withstand the greatest flexural stress.

Preferred embodiments of the invention will be further explained below.

DETAILED DESCRIPTION OF THE PREFERRED EMBODIMENTS

Figures 1, 2, 3:
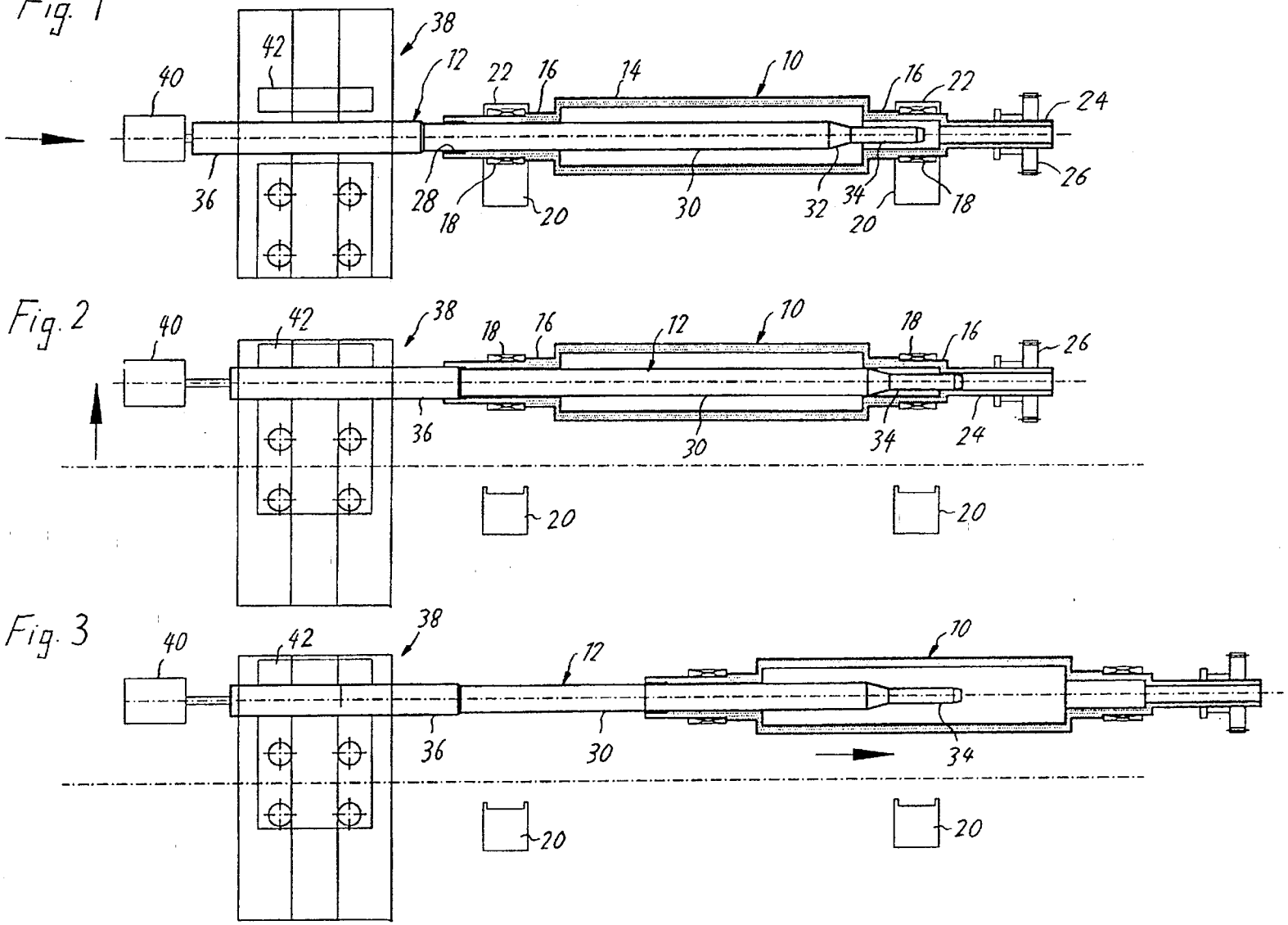
FIGS. 1 to 3 are schematic longitudinal sections through an apparatus according to a first embodiment of the invention, in three different positions before and during the replacement of the sleeve.

FIGS. 1 to 3 show, each in longitudinal section, a printing cylinder sleeve, herein referred to for brevity as sleeve 10, formed preferably of metal, which is mounted replaceably on a shaft 12. The middle section of sleeve 10 is configured as a hollow cylindrical drum 14 whose outer circumferential surface serves for mounting printing plates not shown. The drum 14 is adjoined coaxially at each end by a hollow journal 16 which is affixed to the end wall of the drum 14. Each journal 16 is inserted in a roller bearing 18 which is held in a bearing block 20. In FIG. 1 a bearing cover 22 is fixed on the bearing block, so that the roller bearing 18 is surrounded and held in position.

At one end of the sleeve 10 (right end in the drawing) the journal 16 has a tubular prolongation 24 of reduced diameter. On this prolongation a gear 26 is fastened which meshes with a driving gear, not shown, of the printing machine.

The right end in the drawing, on which the gear 26 is situated, is to be referred to herein as the drive end, while the opposite end is to be called the control end.

The inside diameter of the sleeve 10 diminishes in steps from the drum 14 to the journal 16 and on to the prolongation 24. At the control end an internal recess or bored portion 28 is turned in the journal 16, at the outer end of the latter.

The shaft 12 has a main section 30 which in FIG. 1 extends with slight clearance through the control-end journal 16 and is joined after a taper 32 to an end section 34 of smaller diameter. The end section 34 also is followed by a taper. At the opposite end, a base section 36 of larger diameter joins the main section 30 with a short taper, extends through an elevating means or lifter 38 and is connected at the free end with an axial drive 40.

FIG. 1 shows the condition during operation of the printing machine, in which the sleeve 10 is driven through the gear 26, while the shaft 12 is held in the lifter 38 against rotation, and does not touch the sleeve 10 at any point. When the printing machine is stopped (or at least when the printing mechanism pertaining to the sleeve 10 is stopped) and the sleeve 10 including the gear 26 is to be replaced, first the bearing cover 22 is removed so that the bearing blocks 20 are open at the top. Then the axial drive 40 is actuated in order to extend the shaft 12 horizontally toward the drive end. The end section 34 thus fits into the bore in the tubular prolongation 24, the main section 30 of the shaft fits into the bore of the drive end journal 16, and the base section 36 of the shaft fits into the bored portion 28 of the other journal, as is shown in FIG. 2. In this procedure the taper surfaces of the shaft 12 facilitate insertion.

Then the base section 36 of the shaft is clutched by a jaw 42 of the lifter 38 and held tightly, and the shaft 12, held fast in this manner, is raised together with the sleeve 10 by the lifter 38 to the position shown in FIG. 2. The journals 16 with the roller bearings 18 are thus lifted out of the bearing blocks 20 so that the sleeve 10 as a whole is cantilevered above the bearing blocks 20. In this state the unit including sleeve 10, gear 26 and roller bearings 18 are drawn off from the shaft 12 axially toward the drive end, as shown in FIG. 3.

Then another sleeve 10, different from the removed sleeve only in the outside diameter of the drum 14, can be installed, by performing in reverse order the steps described above. At the same time the insertion of the bearings 18 into the bearing blocks 20 in the correct position is facilitated by the fact that, as the sleeve is lowered by the lifter, it is held with no free play on the shaft 12 (as in FIG. 2).

The apparatus described above has the advantage that the shaft 12 does not rotate together with the sleeve 10 even when the printing machine is running, which permits a simpler fixation of the base section 36 in the lifter 38 as well as a simple coupling of the shaft to the axial drive 40. Instead of the jaw 42, therefore, a permanently effective axial guidance can be provided in the elevating means for the shaft.

During the phases in which the sleeve 10 is lifted away from the bearing blocks 20, both journals 16 are still engaged with the shaft 12, so that the inherent stiffness of the sleeve also contributes to the stabilization of the shaft 12, and the bending forces acting on the shaft held at only one end, due to the weight of the sleeve, can be better withstood. These bending forces occur mainly in the base section 36 of the shaft, which in this design has the largest diameter.

In a modified embodiment it is also possible to reduce the outside diameter of the shaft 12, at least in the sections lying within the sleeve 10, such that it will be smaller than the smallest inside diameter of the sleeve, so that during operation of the printing machine (in the state corresponding to FIG. 1) there will be overall a sufficient annular gap between the shaft 12 and the sleeve 10, and the sleeve mounted in the bearing blocks 20 will be able to rotate freely. In this case the axial drive 40 can be omitted. If the sleeve is raised by means of the lifter and clamping mechanism 38 and the shaft 12, the top of the shaft will contact the inside circumference of the sleeve after a short travel, so that, as the upward movement continues, the sleeve will be carried upward.

Figures 4, 5, 6:
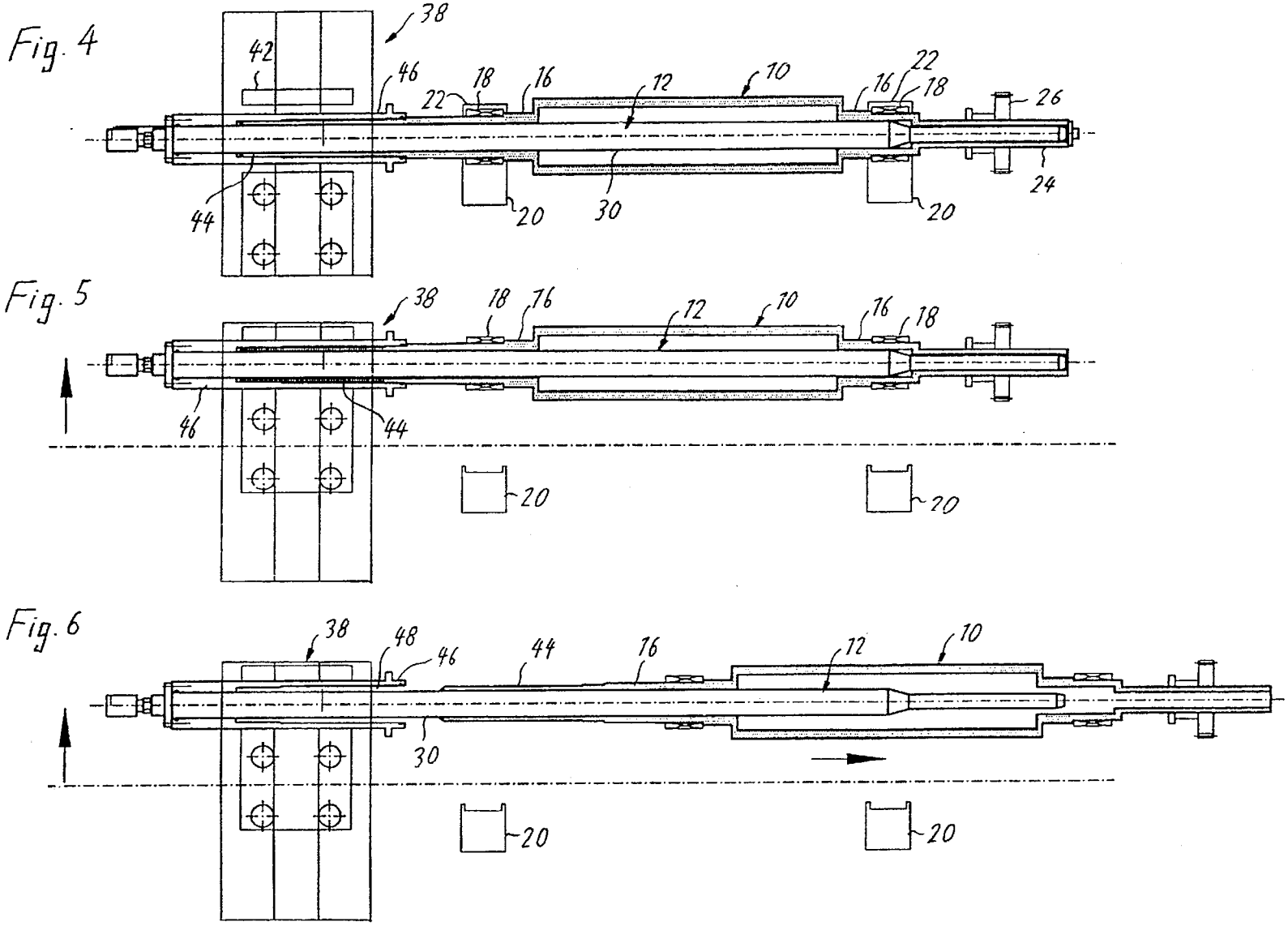
FIGS. 4 to 6 are similar to FIGS. 1 to 3, but for a different embodiment of the invention.

FIGS. 4 to 6 show another embodiment wherein the shaft 12 rotates with the sleeve 10 during operation of the printing machine (in the state shown in FIG. 4). The journal 16 on the drive end is longer in this embodiment and furthermore also has a tubular prolongation 44 of smaller diameter. In this case, the sleeve 10 is held with its journal 16 on the shaft 12 so as to be substantially free of play, yet axially displaceable thereon. Instead of the base section 36, the shaft has a bush 46 in the portion that passes through the lifter 38 and forms with the main section 30 of the shaft an annular gap 48 open at the drive end (FIG. 6). The jaw 42 of the lifter clutches the outer circumference of the bush 46 while it is lifting it (FIG. 5). An end section of the bush 46 fits precisely on the circumference of the shaft 12, so that the forces of weight acting on the shaft 12 are transferred to the bush 46, and can then be absorbed by the clamp mechanism.

In the states shown in FIGS. 4 and 5 the tubular prolongation 44 of the drive end of journal 16 enters into the annular gap 48 between the bush 46 and the main section 30 of the shaft 12, so that a connection between the sleeve and the shaft is made resistant to flexure.

When the sleeve 10 is to be changed, in this case only the bearing cover 22 is removed, and the bush 46 is gripped by the jaw 42 without any axial movement of the shaft 12. Then the shaft 12 together with the sleeve 10 is lifted up by means of the lifter and clamping mechanism 38 (FIG. 5), and the sleeve 10 is drawn axially off from the shaft 12 (FIG. 6). In installing a new sleeve, the steps described above are performed in reverse order. In the final phase the lifter 38 is opened to such an extent that the shaft 12 and the bush 46 can rotate together with the sleeve 10.

What is claimed is:

1. Apparatus for changing printing cylinder sleeves in printing machines, comprising:

two bearing blocks which serve for rotatable support of a printing cylinder sleeve during operation of the printing machine, a shaft running axially through the printing cylinder sleeve, a lifter disposed at one end of the shaft outside of one bearing block, by which the shaft together with the printing cylinder sleeve can be cantilevered and raised so that the printing cylinder sleeve comes free of the bearing blocks and can be removed axially from the shaft, and the printing cylinder sleeve is provided with hollow journals at both its ends, which are held in the bearing blocks during the operation of the machine.

2. Apparatus according to claim 1, wherein during the operation of the machine a radial clearance exists between the printing cylinder sleeve and the shaft such that the printing cylinder sleeve mounted in the bearing blocks is freely rotatable while the shaft is stopped.

3. Apparatus according to claim 2, wherein:

the shaft is adjustable axially between a working position and an extended position relative to the bearing blocks by means of an axial drive, the printing cylinder sleeve has sections of different inside diameters, the shaft has sections, and in the extended position the sections of the shaft each lie in sections of the printing cylinder sleeve having inside diameters equal to outside diameters of the respective shaft sections, while in the working position the sections of the shaft are entirely within sections of the printing cylinder sleeve which have larger respective inner diameters.

4. Apparatus according to claim 3, wherein the outside diameter of the shaft decreases from the end held in the lifter toward the opposite end.

5. Apparatus according to claim 1, wherein the shaft is held for co-rotation in the printing cylinder sleeve mounted in the bearing blocks and can rotate freely in the lifter during the operation of the machine.

6. Apparatus according to claim 5, wherein on one end of the shaft a bush is fixedly fastened whose outer circumference is grasped by the lifter and which forms with the shaft an annular gap open toward the opposite end of the shaft, and a tubular prolongation of a journal of the printing cylinder sleeve is engaged therein.

7. Apparatus according to claim 1, wherein the journals of the printing cylinder sleeve each bear a roller bearing which, when the printing cylinder sleeve is being replaced, can be lifted out of the bearing blocks together with the printing cylinder sleeve.

8. Apparatus according claim 1, wherein a gear serving for the rotary driving of the printing cylinder sleeve is mounted for co-rotation on the printing cylinder sleeve and forms with the latter a replaceable unit.

9. Apparatus according to claim 8, wherein the journal on the end of the printing cylinder sleeve opposite the lifter has a tubular prolongation projecting toward the free end, which bears the gear.

* * * * *